United States Patent [19]

Romanovsky et al.

[11] 4,210,813

[45] Jul. 1, 1980

[54] IONIZING RADIATION GENERATOR

[76] Inventors: Vladimir F. Romanovsky, proezd Shokalskogo,4,korpus 1,kv.13; Vadim S. Panasjuk, 3 Schukinsky proezd,3,kv.80; Boris M. Stepanov, Leninsky prospekt,57,kv.34; Alexandr M. Ovcharov, Balaklavsky prospekt,4,korpus 2,kv.104; Jury A. Akimov, Vladimirskaya ulitsa,4,kv. 10, all of Moscow, U.S.S.R.

[21] Appl. No.: 961,378

[22] Filed: Nov. 16, 1978

[30] Foreign Application Priority Data

Jan. 9, 1978 [SU] U.S.S.R. ..... 2568767

[51] Int. Cl.[2] ..... H05G 1/10

[52] U.S. Cl. ..... 250/421; 250/419; 250/493; 250/501

[58] Field of Search ..... 250/419, 402, 421, 493

[56] References Cited

U.S. PATENT DOCUMENTS

| | | | |
|---|---|---|---|
| 1,160,177 | 11/1915 | Kelly | 250/419 |
| 1,917,625 | 7/1933 | Werner | 250/421 |
| 2,365,855 | 12/1944 | Atlee | 250/421 |
| 3,643,094 | 2/1972 | Courtois | 250/402 |

*Primary Examiner*—Harold A. Dixon

*Attorney, Agent, or Firm*—Steinberg and Blake

[57] ABSTRACT

The proposed ionizing radiation generator comprises an ionizing radiation emitter including a resonance transformer whose field winding is arranged near the low-voltage end of the step-up winding, electrically associated with the electrically conducting housing of the resonance transformer. The emitter also includes an accelerating tube whose high-voltage electrode is coupled to the high-voltage end of the step-up winding of the resonance transformer and attached to one of the ends of the tubular insulator of the accelerating tube which accommodates the step-up winding. The low-voltage electrode of the accelerating tube is electrically associated with the housing, while a source of charged particles is arranged in the evacuated inner space of the accelerating tube disposed between the housing and the tubular insulator, one of the electrodes of the tube being electrically associated with the charged particle source.

2 Claims, 5 Drawing Figures

IONIZING RADIATION GENERATOR

FIELD OF THE INVENTION

The present invention relates to ionizing radiation sources, and more particularly to an ionizing—X—, electron or neutron—radiation generator.

Depending on the type of ionizing radiation, the present invention can be used either as an X-ray generator of a generator of accelerated electrons or a neutron generator. When used as an X-ray generator, the invention can find application in nondestructive testing and in medicine, as well as for registering fast processes; as an accelerated electron generator, the invention can be used in radiation chemistry and for sterilizing medical materials; and as a neutron generator, the invention can be used in geophysical research, neutronography and activation analysis of substances.

BACKGROUND OF THE INVENTION

The principal component of most ionizing radiation generators is the ionizing radiation emitter comprising an accelerator of charged particles. The emitter of an X-ray or accelerated electron generator includes an electron accelerator, while that of a neutron generator normally contains an ion accelerator. An ionizing radiation generator may also comprise an emitter power supply and other auxiliary units. The energy ranges covered by the charged particle accelerators forming part of prior art ionizing radiation generators are approximately as follows: 30 to 1,000 keV for X-ray generator, 300 to 1,000–1,500 keV for accelerated electron generators, and 100 to 400 keV for neutron generators involving synthesis of deuterium and tritium nuclei. No particular difficulties arise in designing stationary versions of such accelerators. However, for practical purposes, portable ionizing radiation generators are gaining in importance for they can substantially extend the area of research and other activities necessitating their use, particularly in cases where the object of investigation cannot be delivered to the ionizing radiation generator, e.g. in nondestructive testing of large units or stationary installations, in examining wells, or when such generators are intended for use in mobile laboratories. The application of portable ionizing radiation generators increases the efficiency and productivity, the main advantages being the self-containment and portability of their emitters, which permits, for example, nondestructive testing of a large unit, ensures high mobility, and enables placing them in difficult-to-access spots. The portability of ionizing radiation generator emitters implies, first of all, high values of their specific output parameters, i.e. output parameters relative to the emitter weight or mass, for an emitter featuring higher specific output parameters, such as the mean accelerated electron beam power of a radiation phase, quantum energy of X- or accelerated electron radiation, may replace a more cumbersome emitter with low values of the same parameters. For example, what are considered to be portable emitters of pulsed X-ray apparatus feature low mean accelerated electron beam power of about 2–3 W/kg and low mean X-ray dose at sufficiently high maximum accelerated electron energy of about 20–30 keV/kg (cf. parameters of the IRA-2D apparatus in V. K. Shmelev's "X-Ray Apparatus", "Energiya" Publishers, Moscow, 1973, pp. 408–410 [in Russian]).

In pulsed X-ray emitters it is difficult, in principle, to increase the mean accelerated electron beam power because of the anode design which makes heat removal difficult. Besides, pulsed X-ray emitters are characterized by a short service life, bearing in mind that they have an autoemitting cathode which emits currents of about $10^3$ A.

There is known a portable pulsed neutron generator (cf. A. Sh. Allakhverdov et al., "Pulsed Neutron Generator NGI-9 With a Flux of Up To $10^{10}$ n/sec" in "Problems of Nuclear Science and Technology", Radiation Engineering, issue 12, "Atomizdat" Publishers, Moscow, 1975, pp. 182–191 [in Russian]) whose emitter weights about 70 kg and the intensity of the generated neutron flux is $10^{10}$ n/sec. This emitter measuring roughly 300×1,000 mm contains a pulsed deuterium ion accelerator (accelerating tube having a source of deuterium ions) and a pulsed high-voltage transformer generating accelerating voltage pulses 150 kV in amplitude and about 1 μsec in duration. The high neutron flux is primarily due to the need to increase the accelerating voltage applied to the accelerating tube up to 300–400 kV. However, the above neutron generator design fails to provide for the same condition at the same size and with the same accelerating tube.

Also known are X-ray apparatus the emitter whereof comprises an accelerating tube and a high voltage source energized from industrial mains (cf. X-ray apparatus "Baltograph 300/3P" manufactured by the Belgian company "Balteau" and described in V. K. Shmelev's book "X-Ray Apparatus", "Energiya" Publishers, Moscow, 1973, pp. 146–147 [in Russian]. The emitter of such apparatus is normally built around a circuit with opposite-phase power supply to the accelerating tube at a total voltage difference of up to 300–400 kV. The specific accelerated electron beam power of such an emitter is about 20 to 30 W/kg, i.e. higher then in pulsed X-ray apparatus. However, the maximum specific accelerated electron energy is only about 5 keV/kg. In addition, attaining, in such a design, an accelerating voltage exceeding 400 kV involves enormous technological difficulties.

There are known X-ray and accelerated electron generators of the "Elita-1" type with an emitter containing an accelerating tube and a high voltage source in the form of a Tesla transformer (cf. Ye. A. Abramyan and S. B. Vasserman, "Heavy Current Pulsed Electron Accelerators". Atomnaya Energiya, vol. 23, issue 1, July 1967 [in Russian]. The specific accelerated electron beam power of such a generator is about 67 W/kg, i.e. the highest of all the generators considered above, and the maximum electron energy is about 8.3 keV/kg (less than in the case of pulsed X-ray apparatus).

Another ionizing radiation generator is known in which the ionizing radiation emitter includes a resonance transformer whose field winding is arranged near the low-voltage end of the step-up winding, electrically associated with the electrically conducting housing of the resonance transformer, and an accelerating tube whose high-voltage electrode is coupled to the high-voltage end of the step-up winding and attached to one end of the tubular insulator of the accelerating tube, the low-voltage electrode is electrically associated with the housing of the resonance transformer, and a charged particle source is provided in the evacuated space of the accelerating tube and electrically associated with one of its electrodes (cf. B. I. Al'bertinsky et al., "Mobile X-Ray Unit Based on Resonance Transformer", Defektoskopiya, No. 5, 1971, pp. 115–119 [in Russian]).

The emitter of this generator is made as an integral unit including an accelerating tube and a resonance transformer and is enclosed in an electrically conducting cylindrical container which is the housing of the resonance transformer, accommodating the accelerating tube arranged coaxially therewith. The casing of the accelerating tube is in the form of a tubular insulator with airtight ends, made up of twelve glass tube sections attached to one another with intermediate metal annular electrodes being sealed therebetween. The tubular insulator terminates, at the end facing the interior of the resonance transformer housing, in the high-voltage electrode of the accelerating tube, secured whereon and coupled whereto is a source of charged particles, or the cathode assembly of the tube. The opposite end of the tubular insulator terminates in the low-voltage electrode which is essentially an external hollow anode associated with the housing of the resonance transformer. The evacuated space of the accelerating tube, wherein the charged particles are accelerated, is confined between the tubular insulator on one side and the external hollow anode on the other.

Arranged above the tubular insulator is the step-up winding of the resonance transformer, whose high-voltage end is connected to the high-voltage electrode of the accelerating tube, and the low-voltage end is electrically associated, via measuring devices, with the housing of the resonance transformer.

The taps of the step-up winding are connected to the intermediate annular electrodes of the tubular insulator of the accelerating tube for a more even distribution of the potentials over its length.

Arranged near the low-voltage end of the step-up winding is the field (primary) winding of the resonance transformer, which is energized from an external power supply whose frequency is adjustable within the range of 430 to 500 Hz for adjusting the operating frequency of the resonance transformer. The space between the tubular insulator and the resonance transformer housing is filled with a gaseous dielectric at a pressure of 10 atm. Electrons are accelerated in the accelerating tube in a direction from the high-voltage electrode to the low-voltge one which is in fact its anode.

The above generator provides for a maximum electron energy of 1,000 keV and a maximum electron beam power of 1,500 W. The X-ray emitter weights 900 kg.

Thus, the maximum specific electron energy of this generator is 1.1 keV/kg and the specific electron beam power is 1.7 W/kg. Such low values of the generator output parameters are due, primarily, to the great thickness of the resonance transformer housing designed for a pressure of 10 atm of the gas filling the space between the housing and the tubular insulator of the accelerating tube, as well as to the large size of the housing, determined by the need to maintain the dielectric strength of the spark gap.

SUMMARY OF THE INVENTION

It is an object of the present invention to provide an ionizing radiation generator featuring high specific output parameters.

The invention resides in that in an ionizing radiation generator wherein an ionizing radiation emitter comprises a resonance transformer whose field winding is arranged near the low-voltage end of a step-up winding, electrically associated with an electrically conducting housing of the resonance transformer, and an accelerating tube whose high-voltage electrode is coupled to the high-voltage end of the step-up winding of the resonance transformer and attached to one of the ends of a tubular insulator of the accelerating tube, the low-voltage electrode being electrically associated with the housing of the resonance transformer, and the evacuated inner space of the accelerating tube accommodating a source of charge particles, electrically associated with one of the electrodes of the accelerating tube, according to the invention, the step-up winding of the resonance transformer is arranged inside the tubular insulator of the accelerating tube whose evacuated inner space is confined between the housing of the resonance transformer and the tubular insulator.

Preferably, in the generator wherein the step-up winding of the resonance transformer is arranged along a helical line coaxially with the tubular insulator, according to the invention, the tubular insulator should essentially be an uninterrupted tubular section, and the coils of the step-up winding should be arranged in the immediate proximity to the inner surface of the tubular section.

In the proposed ionizing radiation generator, evacuation of the space confined between the tubular insulator and the resonance transformer housing permits reducing the thickness of the housing wall, shortening the distance between the wall and the tubular insulator (reducing the size of the emitter) or increasing the accelerating voltage applied to the high-voltage electrode of the accelerating tube, and reducing the weight of the emitter by that of the dielectric which is normally placed in this space. The arrangement of the step-up winding inside the tubular insulator permits effective cooling thereof, for example, with a flow of a liquid dielectric. The tubular insulator being made as an uninterrupted tube section simplifies its structure. The arrangement of the step-up winding along a helical line and in the immediate proximity to the inner surface of the tubular insulator made as a tubular section of a dielectric material ensures, owing to the capacitive currents flowing between the surface of the winding and the walls of the resonance transformer housing, even distribution of the potential over the length of the tubular section and shielding of its interior against the radial high intensity electric field.

BRIEF DESCRIPTION OF THE DRAWINGS

The invention will now be described in greater detail with reference to specific embodiments thereof, taken in conjunction with the accompanying drawings, wherein.

DETAILED DESCRIPTION OF THE INVENTION

Figure 1:
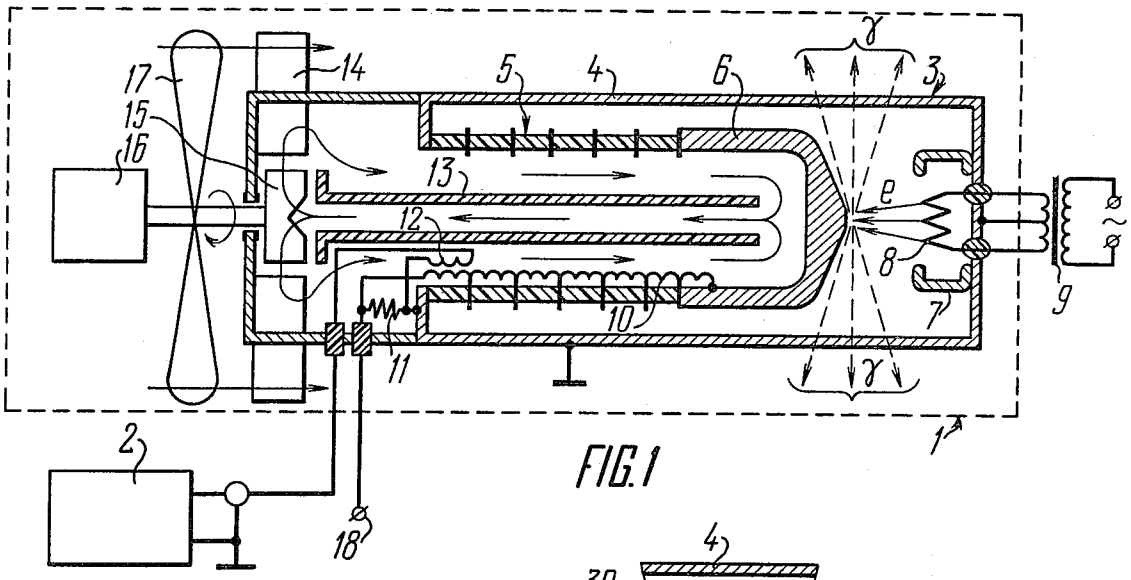
FIG. 1 is a schematic partially cut longitudinal section view of an X-ray generator wherein the source of charged particles is made as a cathode and electrically associated with the low-voltage electrode of the accelerating tube, according to the invention.

The proposed ionizing radiation generator is considered below as an X-ray generator comprising an emitter 1 (FIG. 1) of ionizing radiation, in this case X-rays $\gamma$, connected whereto is a high-frequency oscillator 2. The ionizing radiation emitter 1 includes an accelerating tube 3 the casing whereof comprises a grounded electrically conducting housing 4 of a resonance transformer, a sectionalized tubular insulator 5 and a high-voltage electrode 6 of the accelerating tube 3. Other embodiments are possible wherein the housing 4 is made entirely of metal or has a laminated structure with layers of a metallic and dielectric materials.

The accelerating tube 3 comprises a low-voltage electrode 7 electrically associated with the housing 4 of the resonance transformer and a source of charged particles, made, in this embodiment, as a cathode 8 electrically associated with the low-voltage electrode 7 via a winding of a transformer 9, which does not form part of the emitter 1, and the housing 4. The accelerating tube 3 is evacuated, and the walls of the housing 4 are sufficiently thin to pass X-rays $\gamma$.

The emitter 1 also includes a step-up winding 10 whose high-voltage end is coupled to the high-voltage electrode 6 and whose low-voltage end is electrically associated via a measuring resistor 11 with the housing 4 of the resonance transformer. Arranged near the low-voltage end of the step-up winding 10 is a field winding 12 connected to the high-frequency oscillator 2. The step-up winding 10 is disposed inside the sectionalized tubular insulator 5. The latter also accommodates a tubular section 13 of a dielectric material, wherethrough a coolant which is essentially a liquid dielectric is supplied to the high-voltage electrode 6 and the step-up winding 10. The coolant is also pumped through a radiator 14 by a centrifugal pump 15 rotated by an electric motor 16 which also actuates a fan 17 blowing the external plates of the radiator 14.

The measuring resistor 11 has a tap 18 for connection to an instrument measuring the current at the low-voltage end of the step-up winding 10.

Figure 2:
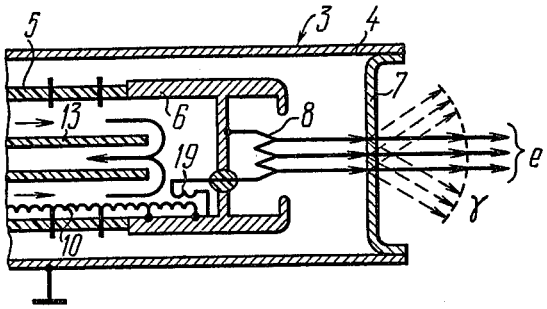
FIG. 2 is a longitudinal section view of the electrode assembly of the accelerating tube of an accelerated electron generator wherein the source of charged particles is made as a cathode and electrically associated with the high-voltage electrode of the accelerating tube, according to the invention.

FIG. 2 shows an embodiment of the electrode assembly of the accelerating tube 3 of the emitter 1 of FIG. 1. Therein, the source of charged particles is made as the cathode 8 electrically associated with the high-voltage electrode 6, one end of the cathode 8 being connected to the latter directly and the other, via a winding 19 inductively coupled to the step-up winding 10 of the resonance transformer and providing for heating of the cathode 8. The low-voltage electrode 7 is built in the housing 4, is electrically associated therewith and, at the same time, serves as the anode of the accelerating tube 3 and as a window for letting out accelerated electrons e or X-rays $\gamma$, depending on the thickness of the electrode 7 and on the material of which it is made.

Figure 3:
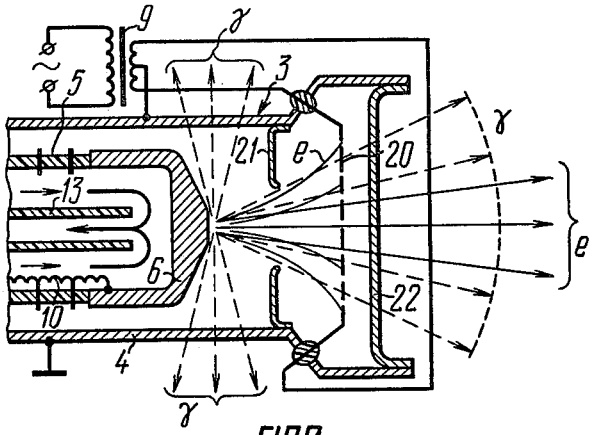
FIG. 3 is a longitudinal section view of the electrode assembly of the accelerating tube of an X- and accelerated electron generator wherein the source of charged particles is electrically associated with the low-voltage electrode of the accelerating tube and made as a mesh cathode transparent to X-rays and accelerated electron beam, according to the invention.

FIG. 3 represents an embodiment of the electrode assembly of the accelerating tube 3 of the emitter 1 shown in FIG. 1. Therein, the source of charged particles is made as a mesh cathode 20 transparent to X-rays $\gamma$ and accelerated electrons e and electrically associated via the winding of the transformer 9 with a low-voltage electrode made as a focusing diaphragm 21 connected to the housing 4. The mesh cathode 20 is mounted between the focusing diaphragm 21 and a window 22 which, depending on the thickness and the material of which it is made, passes only X-rays $\gamma$ or X-rays $\gamma$ and accelerated electrons e. Depending on the mode of operation of the accelerating tube 3, the surface of the high-voltage electrode 6 bombarded by the electrons emitted by the mesh cathode 20 may become another source of electrons, associated with the high-voltage electrode 6. In the embodiment under consideration, the walls of the housing 4 are made sufficiently thin for passage therethrough of X-rays $\gamma$.

Figure 4:
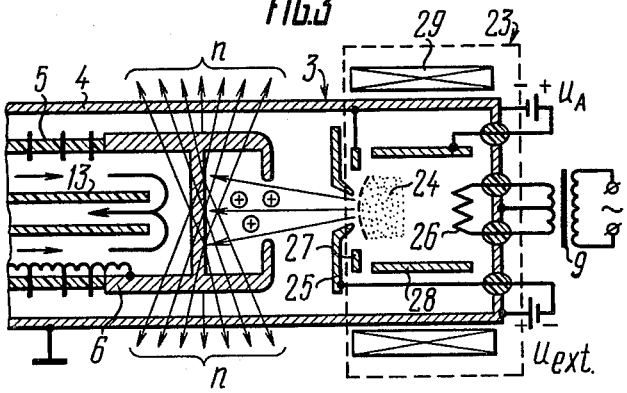
FIG. 4 is a longitudinal section view of the electrode assembly of the accelerating tube of a neutron generator wherein the source of charged particles is made as a Penning ion source and electrically associated with the low-voltage electrode of the accelerating tube, according to the invention.

Shown in FIG. 4 is an embodiment of the electrode assembly of the accelerating tube 3 of the emitter 1 represented in FIG. 1. In this case, the emitter generated neutrons n. The source of charged particles is made as an ion source 23 electrically associated through a plasma 24 with a low-voltage electrode of the accelerating tube 3, made as an extractor 25 of ions from the plasma 24.

The surface layer of the high-voltage electrode 6, bombarded by ions, contains tritium. The ion source 23 contains deuterium or a mixture of deuterium with tritium at a pressure of about $10^{-3}$ mm Hg. The source 23 is essentially a Penning ion source and includes a cathode 26 connected to the housing 4 via the winding of the transformer 9, an anticathode 27 also connected to the housing 4, an anode 28 connected to the housing 4 via a source of voltage $U_a$, and a solenoid 29. The ion extractor 25 is electrically associated with the housing 4 through a source of voltage $U_{ext}$.

Figure 5:
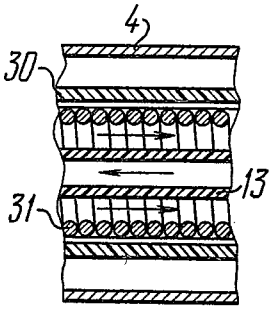
FIG. 5 is a longitudinal section view of the step-up winding of the resonance transformer, arranged along a helical line coaxially with the tubular insulator, whose coils are arranged in the immediate proximity to the inner surface of the tubular insulator made as an uninterrupted tubular section, according to the invention.

FIG. 5 shows an embodiment of the tubular insulator, the step-up winding and their mutual arrangement in the emitter 1 of FIG. 1. The tubular insulator is made in the form of an uninterrupted tubular section 30 of a dielectric material. In this embodiment, the step-up winding 31 is arranged along a helical line and its coils are in the immediate proximity to the inner surface of the tubular section 30.

The X-ray generator shown in FIG. 1 operates as follows

The voltage from the high-frequency oscillator 2 is applied to the field winding 12 of the resonance transformer. Therewith, the frequency of the voltage applied to the field winding 12 of the resonance transformer must be equal or close to the resonance frequency of its secondary oscillatory circuit formed by the inductance of the step-up winding 10 and the capacitances between the winding 10 and the housing 4, as well as between the electrode 6 and the housing 4. Then, between the high-voltage electrode 6 and the low-voltage electrode 7 there appears an alternating accelerating voltage of the same frequency, but much higher than the voltage applied to the field winding. The amplitude of the accelerating voltage depends on the Q factor of the above-mentioned oscillatory circuit and on the load current of the accelerating gap between the high-voltage electrode 6 and low-voltage electrode 7. It can be determined by measuring the amplitude of the current through the resistor 11.

The load current flows owing to the charged particles emitted by the charged particle source which, in this embodiment, is the cathode 8. The cathode 8 is heated by the transformer 9. The electrons emitted by the cathode 8 are accelerated in the direction of the high-voltage electrode 6 during each positive voltage half-period thereacross. When the high-voltage electrode 6 is bombarded by electrons, X-rays $\gamma$ are generated, which can pass beyond the accelerating tube 3 through the walls of the housing 4 in the direction indicated in FIG. 1. Since the X-rays are generated only during positive voltage half-periods across the accelerating electrode 6, they are intermittent and can be used for taking a cinegram of a fast process or a fast moving object. During operation of the apparatus, in the step-up winding 10, due to losses in the wires of this winding, and in the high-voltage electrode 6, due to its bombardment by electrons, heat is released which has to be removed. To this end, supplied to the step-up winding 10 and into the space accommodating the high-voltage electrode 6 is a coolant whose flow is indicated by arrows in FIG. 1. The coolant flows in a closed loop from the centrifugal pump 15, through the radiator 14, along the step-up winding 10 and the surface of the high-voltage electrode 6 back to the pump 15 through the tubular section 13. The heat carried by the coolant is transferred by heat conduction from the inner plates of the radiator 14 to the external plates which are cooled by an air flow created by the fan 17 as is shown in FIG. 1. The pump 15 and the fan 17 are actuated by the motor 16.

The above-described design of the ionizing radiation generator features a number of advantages. In this generator, the housing of the resonance transformer also serves as part of the accelerating tube casing, while the gaseous or liquid insulation between the high-voltage electrode and the housing of the resonance transformer are replaced by a vacuum gap whose dielectric strength can be much in excess of that of a dielectric. The absence of high pressure within the housing of the resonance transformer enables making it much thinner. Owing to these factors the generator can be made with a much more compact and lighter emitter featuring higher values of specific output parameters. In addition, the generator permits effective monitoring of fast processes with sequential radiograms following at a frequency of several hundred thousand per second, i.e. at the resonance frequency of the oscillatory circuit of the resonance transformer. Also note the easy access to the step-up winding of the resonance transformer, which facilitates its cooling and replacement. Another important factor is that, unlike a high-voltage gap filled with a dielectric, a vacuum gap does not entail additional losses in the oscillatory circuit of the resonance transformer due to bias currents, which improves the Q factor of this circuit.

The design of the resonance transformer, obtaining of the accelerating potential difference and cooling of the step-up winding 10 and electrode 6 in the embodiments of ionization radiation generators whose electrode assemblies are illustrated in FIGS. 2, 3 and 4 are similar to those described above.

Operation of the accelerated electron generator the electrode assembly whereof is shown in FIG. 2 has the following peculiarities. The capacitive current flowing between the housing 4 and high-voltage electrode 6 and also through the high-voltage end of the step-up winding 10, induces a current in the winding 19. This currents heats the cathode 8. The electrons emitted by the latter are accelerated in the direction of the low-voltage electrode 7 within the half-periods during which the potential across the high-voltage electrode 6 is negative. At electron energies of 300 keV and above, the electrons can be effectively brought out from the accelerating tube 3 in the form of a beam of accelerated electrons e through the low-voltage electrode 7 if it is fabricated from a thin low-density material, such as aluminum or titanium foil 50 to 100 microns. If the low-voltage electrode is made of a high-density material, e.g. thick tungsten foil (0.2 to 0.3 mm), the generator will produce X-rays $\gamma$.

Apart from the advantages of the embodiment shown in FIG. 1, this embodiment permits obtaining accelerated electron beams as well as intensive X-rays at accelerated electron energies above 300–400 keV for at such energies the X-radiation pattern features a clearly defined maximum in the direction of travel of accelerated electrons.

The X-ray and accelerated electron generator whose electrode assembly is shown in FIG. 3 operates as follows The mesh cathode 20 emits an electron beam which bombards the surface of the high-voltage electrode 6. Therewith, during positive half-periods of the voltage across the high-voltage electrode 6, quanta of X-rays $\gamma$ appear on its surface, which, in an electrode assembly designed as indicated, can issue both in a radial (through the housing walls) and in an axial (through the mesh cathode 20 and window 22) directions. If the mode of operation of the emitter has been selected such that the surface of the high-voltage electrode 6 is heated, as a result of the bombardment, to an extent whereby it starts emitting electrons itself, during negative half-periods of the voltage across the electrode 6 these electrons are accelerated toward the window 22. Thus, the electrons may exit from the evacuated accelerating tube 3.

The presence of the focusing diaphragm 21 permits using a large-area mesh cathode which is less susceptible to ion bombardment and, therefore, can be made of a material exhibiting a low electron work function, e.g. of thoriated tungsten.

One of the additional advantages of this embodiment of an ionizing radiation generator is its versatility. In addition, such a design permits using both a radial X-ray beam and an axial one, which extends the area of application of the generator and can enhance its efficiency in nondestructive testing through simultaneous use of both beams. It should also be noted that the proposed design of the mesh cathode makes it possible to improve its efficiency by fabricating it from a material with a low work function.

The neutron generator whose electrode assembly is shown in FIG. 4 operates as follows.

The cathode 26 of the ion source 23 is heated with the aid of the transformer 9. Current is passed through the winding of the solenoid 29, whereby an axial magnetic field is created within the ion source 23. Applied to the anode 28 of the ion source 23 is positive voltage $U_a$. Then, in the deuterium or deuterium-tritium mixture filling the ion source 23 at a pressure of about $10^{-3}$ mm Hg, a Penning discharge is initiated due to axial oscillation of electrons, and the plasma 24 is formed. Negative voltage $U_{ext}$ is applied to the ion extractor 25. An accelerating voltage is provided in a manner described above between the high-voltage electrode 6 and the low-voltage electrode, in this case, the extractor 25. Deuterium ions are extracted by the field of the extractor 25 and start accelerating toward the high-voltage electrode 6 within the half-periods during which the potential thereacross is negative. They bombard the surface layer of the high-voltage electrode 6, saturated with tritium, and trigger a synthesis reaction between deuterium and tritium, with neutrons having an energy of about 14 MeV being emitted. The tritium ions bombarding the high-voltage electrode 6 compensate for the tritium lost in its surface layer.

The main advantage of this embodiment of a neutron generator is the possibility to accelerate ions up to energies of 300–400 keV, thereby effectively using the beam of accelerated ions and obtaining intensive neutron beams with the aid of a small neutron emitter.

The ionizing radiation generator with a tubular insulator made as an uninterrupted tubular section and with a step-up winding arranged along a helical line coaxially with the tubular section as shown in FIG. 5, operates similarly as described above.

This embodiment is advantageous in that the surface of the wires of the step-up winding 31 faces the coolant flow, whereby it is intensively cooled. Turbulent flow of the coolant may cause formation of gas bubbles therein. However, the above design of the step-up winding 31 ensures shielding of the coolant against high-intensity electric fields with the result that the appearance of gas bubbles in the coolant does not lead to an electric breakdown. In addition, the close proximity of the coils of the step-up winding 31 to the surface of the tubular section 30 provides for a more even distribution of potentials over its length, whereby its dielectric strength is enhanced.

What is claimed is:

1. An ionizing radiation generator comprising:

an ionizing radiation emitter including a resonance transformer and an accelerating tube;

a field winding and a step-up winding, having a low-voltage and high-voltage ends, of said resonance transformer, said field winding of said resonance transformer being arranged near said low-voltage end of said step-up winding;

an electrically conducting housing of said resonance transformer, electrically associated with said low-voltage end of said step-up winding;

a high-frequency oscillator electrically associated with said field winding;

a high-voltage electrode of said accelerating tube, connected to said high-voltage end of said step-up winding of said resonance transformer;

a tubular insulator of said accelerating tube, secured in said electrically conducting housing of said resonance transformer, said high-voltage electrode being attached to one end thereof;

an inner space of said tubular insulator, accommodating said step-up winding of said resonance transformer;

an evacuated inner space of said accelerating tube, confined between said electrically conducting housing of said resonance transformer and said tubular insulator;

a low-voltage electrode of said accelerating tube, arranged in said electrically conducting housing of said resonance transformer and electrically associated with said housing;

a source of charge particles of said accelerating tube, arranged in said evacuated space and electrically associated with one of said electrodes;

a coolant supplied into said inner space of said tubular insulator, to said step-up winding of said resonance transformer and to said high-voltage electrode of said accelerating tube.

2. An ionizing radiation generator as claimed in claim 1, comprising:

said tubular insulator made as an uninterrupted tubular section;

said step-up winding of said resonance transformer, arranged along a helical line coaxially with said tubular section and in the immediate proximity to the inner surface of said tubular section.

* * * * *